US006002200A

United States Patent [19]

Keim et al.

[11] Patent Number: 6,002,200

[45] Date of Patent: Dec. 14, 1999

[54] CAPPED ELECTRIC LAMP

[75] Inventors: Peter C. Keim; Jan Minderhoud; Pieter Verburg, all of Middelburg, Netherlands

[73] Assignee: U.S.Philips Corporation, New York, N.Y.

[21] Appl. No.: 09/007,553

[22] Filed: Jan. 15, 1998

[30] Foreign Application Priority Data

Jan. 15, 1997 [EP] European Pat. Off. ..... 97200117

[51] Int. Cl.[6] ..... H01J 5/50; H01K 1/42

[52] U.S. Cl. ..... 313/318.02; 313/318.08; 313/318.05; 439/612

[58] Field of Search ..... 313/318.02, 318.08, 313/318.05, 623, 624; 439/612, 617

[56] References Cited

U.S. PATENT DOCUMENTS 2,386,190 10/1945 Betts ..... 439/612

2,457,789 12/1948 von Scheven et al. ..... 176/32

3,808,495 4/1974 Win ..... 313/110

5,013,962 5/1991 Desclos ..... 313/318

*Primary Examiner*—Michael H. Day

*Attorney, Agent, or Firm*—F. Brice Faller

[57] ABSTRACT

The capped electric lamp has a cap (3) secured to a sealed lamp vessel (1). The cap (3) has a housing (10) of metal sheet, having a cylindrical shell (11) and remote from the lamp vessel (1) an integral base (13) having an opening (14) therein. A cavity (15) is formed in the base (13) by deforming the base (13) in outward direction. An insulator plate (16) carrying a contact pin (4) and covering the opening (14) is secured in the cavity (15) by means of a folded seam (17) in the housing (10). The seam (17) presses against a side (18) of the insulator plate (16) which faces the lamp vessel (1).

5 Claims, 1 Drawing Sheet

CAPPED ELECTRIC LAMP

BACKGROUND OF THE INVENTION

The invention relates to a capped electric lamp comprising:

a light-transmitting tubular lamp vessel which is sealed in a vacuumtight manner;

an electric element inside the lamp vessel;

a lamp cap provided with a projecting contact pin and fixed to the lamp vessel; and an electrical conductor connected to the electric element and to said contact pin.

The lamp cap has a housing of metal sheet which has a cylindrical shell and an axis, and integral therewith a base which is transverse to the axis and remote from the lamp vessel and which has an opening, in which base a cavity is formed in which an insulator plate is retained by a flanged portion in the housing so as to cover said opening, which insulator plate supports said contact pin such that said contact pin enters the opening.

Such an electric lamp is known from U.S. Pat. No. 2,457,789.

In the known lamp, the cavity in the base of the lamp cap shell is formed by depressing the base is locally inwards. After the insulator plate is introduced into the cavity from the outside, the plate fixed in the cavity by means of a flanged portion which is made in the base. The flanged portion makes the entrance of the cavity smaller and thus closes in the plate. The formation of the cavity has made the housing locally double-walled, which gives the housing a comparatively large material content.

The known lamp is a tubular fluorescent lamp which has two contact pins at its lamp cap. The pins must project from the base over a predetermined minimum length. The flanged portion which keeps the insulator plate in place has a thickness of twice the material thickness of the housing. The contact pins accordingly project less far from the base by said thickness than they do outside the insulator plate. They must be extra long to compensate for this. This is a disadvantage, the more so in the frequently used tubular fluorescent lamps which have two such lamp caps.

SUMMARY OF THE INVENTION

These latter lamps must be rotated about their axis through 90° when placed in a lampholder so as to bring the contact pins into contact with contact points of the holder. The mechanical resistance of the lampholder must be overcome during this by the connection between the lamp vessel, which is rotated about its axis, and the housing of the lamp cap, and by the connection between the housing of the lamp cap and the insulator plate, and by the connection between the insulator plate and the contact pins. Should the insulator plate rotate relative to the housing, the conductors to the contact pins could become short-circuited with one another and/or torn loose, and/or the lamp would not lie in the lampholder in a fixed position. In the known lamp, where the base has a separate opening for each contact pin, a rotation of the insulator plate may result in a short-circuit through and a voltage across the housing of the lamp cap. This problem of a relative rotation does not occur when the lamp cap has only one contact pin. This problem is counteracted in the known lamp in that the housing is given an additional clamping force on the insulator plate by means of a local indentation of the base against said plate.

The known lamp cap has a special mark in its shell, i.e. a groove, for indicating where the contact pins are present when the lamp is placed in a holder, i.e. what rotational position is occupied by the lamp.

SUMMARY OF THE INVENTION

It is an object of the invention to provide a capped electric lamp which has a lamp cap of a simple construction, which requires comparatively little material, and which avoids inter alia a contact pin of additional length.

According to the invention, the base is deformed in outward direction for forming the cavity therein, and the flanged portion inside the housing presses against a side of the insulator plate which faces towards the lamp vessel.

The lamp according to the invention has the advantage that the contact pin projects less far from the base than from the insulator plate by no more than a length equal to the thickness of the base, and also that the housing has a comparatively small material content because double-walled portions are avoided in the housing, apart from the flanged portion.

It is favorable when the flanged portion presses against the insulator plate substantially circumferentially around the axis. This embodiment has the advantage that the insulator plate is supported circumferentially and is accordingly well capable of absorbing forces directed axially towards the lamp vessel and exerted by a lampholder.

The electric element of the lamp may be an electrode in an ionizable medium. An electrical conductor may be present opposite the lamp cap around the lamp for coupling the lamp capacitively to a supply source there. More commonly, the lamp will have a pair of electrodes in an ionizable medium, such as a rare gas, or a rare gas with mercury, as the electric element. In that case the lamp vessel may be coated with a fluorescent material. The lamp vessel then usually has two lamp caps.

The lamp may be designed for preheating an electrode by means of current passage prior to lamp ignition. In that case the lamp cap has two contact pins, each connected to a respective conductor connected to the electrode.

In a special embodiment, the insulator plate has an elongate shape, and the cavity in the base has a corresponding shape. This embodiment has various advantages:

the housing and the insulator plate are locked against mutual rotation by their very shapes, so that friction for achieving this locking effect is of no importance;

the base is not rotationally symmetrical, so that it can be observed from laterally of the lamp which position the lamp cap occupies with its pins relative to a lampholder. Specific marks on the shell of the housing may accordingly be omitted;

the insulator plate has a smaller surface area. The lamp cap requires less of this comparatively expensive material; the insulator plate may be cut from a larger plate with comparatively small material losses owing to wastage; and the flanged portion can support the plate to closer to its center, so that a thinner, less expensive plate can be used for achieving the same strength.

It is favorable when the base has a common opening for the two contact pins. The creepage path between the pins and the shell can then be as great as possible, given the spacing between the contact pins and the diameter of the housing.

The lamp cap may be coupled mechanically to the lamp vessel, for example in that the lamp cap is indented into a cavity in the lamp vessel. Alternatively, the lamp cap may be fastened with cement. It is favorable for this purpose when the insulator plate has a recess which is kept free by the base.

Vapors evolved during curing of the cement in the lamp cap can escape through this, and cannot build up a pressure inside the lamp cap which would displace the lamp cap before the cement has cured. Alternatively, however, the insulator plate may have one or several holes for this purpose.

BRIEF DESCRIPTION OF THE DRAWINGS

An embodiment of the capped electric lamp according to the invention is shown in the drawing, in which.

DESCRIPTION OF THE PREFERRED EMBODIMENTS

Figure 1:
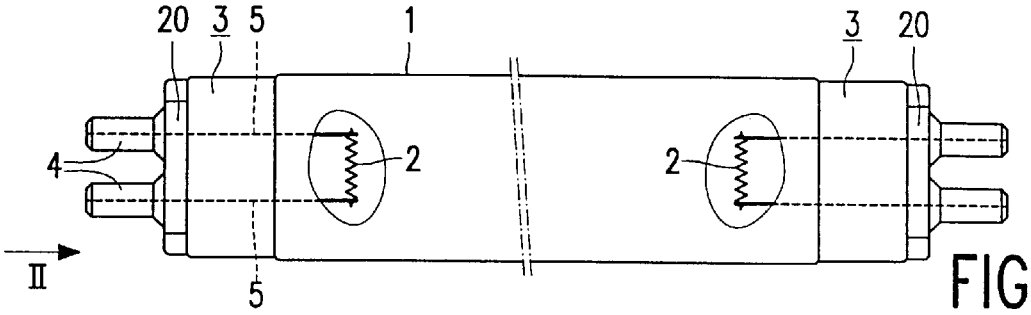
FIG. 1 shows the lamp in side elevation.

In FIG. 1, the capped electric lamp has a light-transmitting tubular lamp vessel 1 which is sealed in a vacuumtight manner and in which an electric element 2 is arranged. A lamp cap 3 provided with a projecting contact pin 4 is fixed to the lamp vessel 1. An electrical conductor 5 is connected to the electric element 2 and to the contact pin 4. The lamp cap 3, see also FIGS. 2 to 4, comprises a housing 10 of metal sheet, having a cylindrical shell 11 and an axis 12, and integral therewith a base 13 which is transverse to the axis 12, which is remote from the lamp vessel 1, and which has an opening 14. A cavity 15 is formed in the base 13, in which cavity an insulator plate 16 is retained over the opening 14 by means of a flanged portion 17 in the housing 10. The insulator plate 16 supports the contact pin 4, the contact pin 4 projecting into the opening 14.

The base 13 is deformed in outward direction for the formation of the cavity 15 therein, and the flanged portion 17 presses inside the housing 10 against a side 18 of the insulator plate 16 which faces towards the lamp vessel 1.

The lamp shown has two identical lamp caps 3, each having two contact pins 4, of which each is connected to the electric element 2 via a respective conductor 5. The lamp shown is a low-pressure discharge lamp whose lamp vessel 1 has a coating of fluorescent powder. The lamp has two electrodes in an ionizable medium, rare gas and mercury, so as to form the electric element 2, which electrodes can be heated by current passage for the purpose of lamp ignition.

Figure 2:
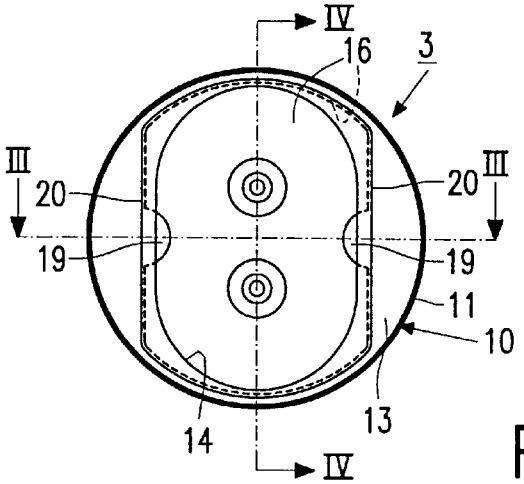
FIG. 2 shows the lamp cap viewed along II in FIG. 1.
Figure 3:
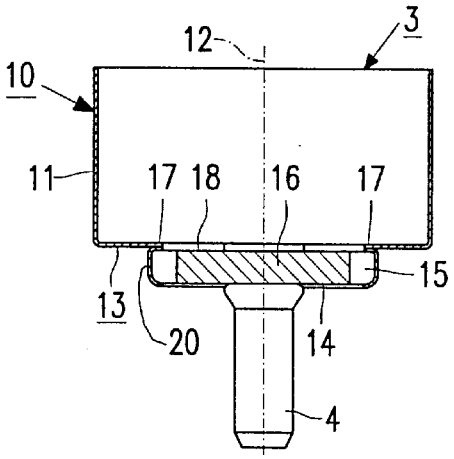
FIG. 3 shows the lamp viewed along III in FIG. 2.
Figure 4:
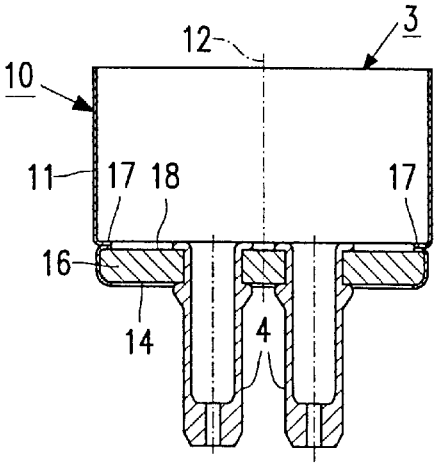
FIG. 4 shows the lamp cap viewed along IV in FIG. 2.

The lamp cap 3 shown, see FIGS. 2 to 4, has a housing 10 of aluminum which was formed from sheet material by deep-drawing. The insulator plate 16, for example made of synthetic resin bonded paper, or alternatively from some other insulator material, for example entirely from synthetic resin, is provided with contact pins 4, fixed therein by flanging, and subsequently introduced into the cavity 15 from the inside. The insulator plate 16 is subsequently fixed by forming the flanged portion 17, visible from the outside of the lamp cap 3 as a circumferential sharp seam. The flange 17 formed in two steps, first by laterally moving dies to perform a dimple above the plate 16, then by vertically moving dies to compress the dimple to form the flange 17 as shown on FIG. 3 and 4.

The insulator plate 16 is elongate in shape, see FIGS. 2 to 4, and the cavity 15 has a corresponding shape.

The flanged portion 17 presses against the insulator plate 16 substantially circumferentially around the axis 12. The insulator plate 16 has a recess 19, two recesses in FIGS. 2 and 3, left open by the base 13 for the purpose of venting the lamp cap 3.

In the embodiment shown, the insulator plate 16 is enclosed in the cavity 15 with narrow fit. Partly as a result of this, a flanged portion 17 which only has a small overlap over the insulator plate 16 can suffice for nevertheless achieving a strong connection. The dimension of the flanged portion implies that comparatively little material is required for the housing. The deformation of the base in outward direction also contributes to this because the housing has no double-walled portions apart from the flanged portion.

The opening 14 in the base 13 is common to the contact pins 4.

Since the insulator plate 16 completely covers the opening 14 in the base 13, which the exception of the recess 19, see FIG. 2, and is supported by the base 13 on the outside over its entire circumference, except for the recess 19 again, it is possible to choose the support at the short edges of the plate 16 to be small, so that the distance from the housing 10 to the adjacent contact pin 4 is nevertheless comparatively great. The support may be chosen to be wider at the long sides of the plate 16, straight sides in the Figure, while maintaining the same minimum distance to the contact pins 4 both in the cross-section parallel to FIG. 3 and in the cross-section of FIG. 4.

The straight sides of the insulator plate 16 manifest themselves on the outside of the lamp cap 3 in the form of a flat side 20 of the housing 10, see FIGS. 1 to 3, which runs parallel to a plane through the contact pins 4, see FIG. 4, as a result of the fact that the plate 16 and the cavity 15 have the same shape, so that the orientation of the contact pins 4 is apparent therefrom when a lamp 1 is placed in a lampholder.

We claim:

1. A capped electric lamp comprising a light transmitting tubular lamp vessel which is sealed in a vacuumtight manner;

an electric element inside the lamp vessel, said electric element being connected to a pair of electrical conductors, a lamp cap comprising a housing formed of metal sheet, said housing having a cylindrical shell with a central axis and an integral base which is transverse to said axis, said base having a flanged portion proximate to said lamp vessel, an opening remote from said lamp vessel, and an elongate cavity lying between said flanged portion and said opening, an elongate insulator plate retained in said cavity, said insulator plate covering said opening and having a side pressed against said flanged portion, and a pair of contact pins supported by said insulator plate and extending through said opening, said contact pins being connected to respective said electric conductors.

2. A capped electric lamp as claimed in claim 1 wherein the flanged portion (17) presses against the insulator plate (16) substantially circumferentially around the axis (12).

3. A capped electric lamp as claimed in claim 1 wherein the opening (14) in the base (13) is common to the contact pins (4).

4. A capped electric lamp as claimed in claim 1 wherein the insulator plate (16) has a recess (19) which is substantially left open by the base (13).

5. A capped electric lamp as claimed in claim 1 wherein the lamp has two said lamp caps (3).

* * * * *